United States Patent [19]

Groeschel, Jr.

[11] Patent Number: 4,791,263

[45] Date of Patent: Dec. 13, 1988

[54] MICROWAVE SIMMERING METHOD AND APPARATUS

[75] Inventor: Edward C. Groeschel, Jr., Lincoln Township, Berrien County, Mich.

[73] Assignee: Whirlpool Corporation, Benton Harbor, Mich.

[21] Appl. No.: 138,297

[22] Filed: Dec. 28, 1987

[51] Int. Cl.[4] ..... H05B 6/68

[52] U.S. Cl. ..... 219/10.55 M; 219/10.55 B; 219/10.55 E; 99/451; 99/333

[58] Field of Search ..... 219/10.55 B, 10.55 M, 219/10.55 R, 10.55 E, 492; 99/451, 325, DIG. 14, 331, 332, 333

[56] References Cited

U.S. PATENT DOCUMENTS

| | | | |
|---|---|---|---|
| 3,470,942 | 10/1969 | Fukada et al. | 219/10.55 B |
| 4,097,707 | 6/1978 | Kobayashi et al. | 219/10.55 B |
| 4,130,749 | 12/1978 | Tanaka et al. | 219/10.55 B |
| 4,311,895 | 1/1982 | Tanabe | 219/10.55 B |
| 4,317,977 | 3/1982 | Buck | 219/10.55 B |
| 4,401,884 | 8/1983 | Kusunoki et al. | 219/492 |
| 4,453,066 | 6/1984 | Mori | 219/10.55 M |
| 4,506,127 | 3/1985 | Satoh | 219/10.55 B |
| 4,520,251 | 5/1985 | Yokozeki | 219/10.55 M |
| 4,665,292 | 5/1987 | Payne | 219/450 |

FOREIGN PATENT DOCUMENTS

| | | | |
|---|---|---|---|
| 2168503 | 6/1986 | United Kingdom | 219/10.55 C |

*Primary Examiner*—Philip H. Leung

*Attorney, Agent, or Firm*—Wood, Dalton, Phillips, Mason & Rowe

[57] ABSTRACT

A method and apparatus for stewing and simmering food in a microwave oven wherein the control causes energization of the microwave generator for a preselected period of time at a preselected low power level correlated with other power levels in the overall heating of the food, including a start-heating, a continued-cooking, and keep-warm cycle. The simmering operation is initiated automatically upon the sensing of the food reaching a temperature slightly below the boiling temperature. The control is selectively operable to provide different times of simmering, as desired by the user.

24 Claims, 2 Drawing Sheets

MICROWAVE SIMMERING METHOD AND APPARATUS

TECHNICAL FIELD

This invention relates to microwave heating apparatus and in particular to such heating apparatus adapted for cooking food.

BACKGROUND ART

In one conventional form of microwave oven, a sensor is provided for determining the cooked condition of the food and for terminating the cooking operation upon determination of a preselected sensed value.

In one form, the sensor comprises a moisture sensor arranged to determine the humidity of the air being exhausted from the oven cavity. In another form, the sensor comprises a gas sensor for determining a gas concentration of reducing gases generated by the heating, such as methane, ethanol, isobutane, carbon monoxide, and hydrogen.

It is further known to heat the food under the control of such sensors in a two-step process wherein the first step is determined by the sensor sensing a preselected value and continuing the cooking operation for a second period of time based on the first period of time. The cooking operation is normally caused to be terminated upon the food being cooked to subjacent its boiling point.

DISCLOSURE OF INVENTION

The present invention comprehends an improved method and apparatus for controlling the cooking of food in a microwave oven including a step of simmering the food at a low power level for a preselected period of time after the food is brought to the subjacent-boiling point condition.

In the illustrated embodiment, the method and apparatus is arranged to cause simmering of the heated food for a preselected period of time at a simmer power level which is less than 50% of the maximum power level of the microwave generator of the microwave oven.

More specifically, the invention comprehends such a method and apparatus wherein the simmer power level is approximately 30% of the maximum power level.

The invention comprehends that the preselected period of time during which the generator is energized at the simmer power level is variable and, in the illustrated embodiment, the period of time is selectively any one of a plurality of different discrete periods of time.

In the illustrated embodiment, one of the discrete periods of time is 60 minutes and another one of the discrete periods of time is 210 minutes.

In the illustrated embodiment, the simmer power level is less than 50% of the power level utilized at the start of the heating of the food, and less than 75% of the power level utilized during a second step of continued heating of the food prior to the simmering operation.

The invention further comprehends the provision of such a method and apparatus wherein the generator is operated at a "keep warm" power level subsequent to the end of the simmer cycle and, in the illustrated embodiment, the simmer power level is greater than twice the "keep warm" power level.

In the illustrated embodiment, the simmer power level is approximately 45% of the start heating power level, approximately 60% of the continued heating power level, and approximately 3 times the "keep warm" power level.

In the illustrated embodiment, the continued heating power level is maintained for a period of time approximately two and one-half times the duration of the start heating power level. In the illustrated embodiment, the determination of the initial cooking time is effected by means of a gas sensor which terminates the initial cooking step when the sensor reaches 65% of its initial value.

In the illustrated embodiment, the first step of the cooking operation is carried out at 70% of the microwave maximum power, the second step thereof is carried out at approximately 50% of the maximum power, and simmer is carried out at approximately 30% of the maximum power, and the "keep warm" operation is carried out at approximately 10% of the maximum power.

The method and apparatus of the present invention are extremely simple and economical while yet providing a highly improved simmering operation in a microwave heating of food-stuffs.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
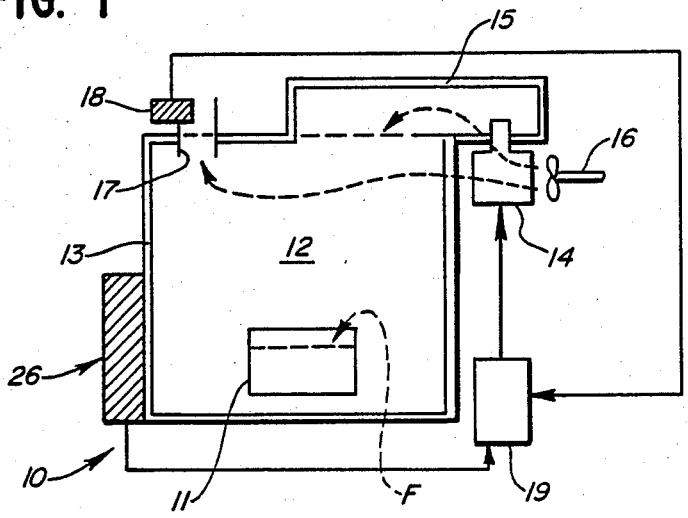
FIG. 1 is a schematic section of a microwave oven apparatus embodying the invention.
Figure 2:
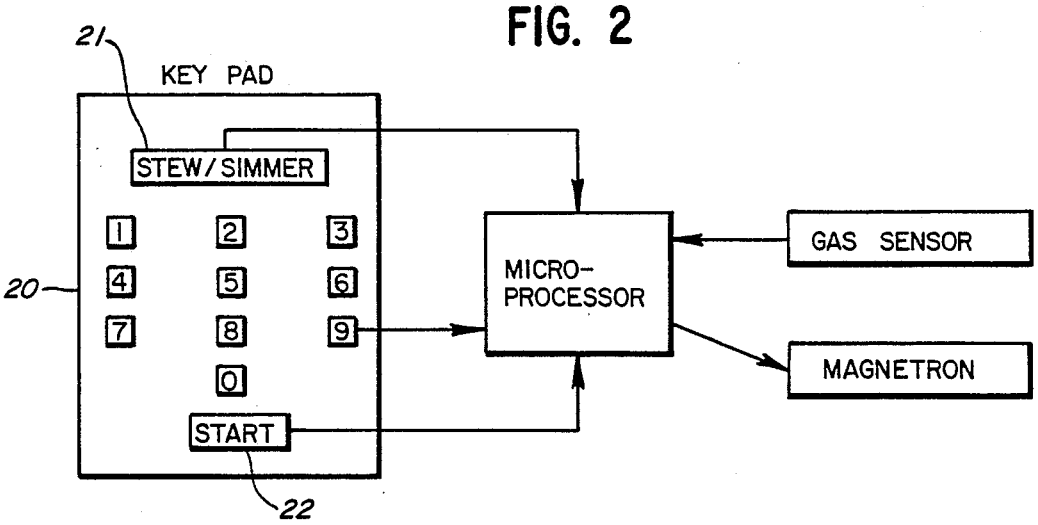
FIG. 2 is a schematic control diagram illustrating the interconnections between the elements of the apparatus.

In the illustrative embodiment of the invention as disclosed in the drawing, a microwave oven generally designated 10 is provided for simmering food F in a suitable container 11 placed in an oven cavity 12 within an outer housing 13 of the microwave oven.

The oven apparatus includes a magnetron microwave generator generally designated 14, of conventional construction, arranged to deliver microwave energy into the oven cavity through a suitable microwave guide 15. A blower 16 is provided for blowing cooling air over the magnetron and delivering the cooling air into the oven cavity from which it is exhausted through an exhaust vent 17. A gas sensor 18 is provided for sensing gases in the exhausting air generated by the cooking of the food. Such gas sensors are well known and function to provide a signal when the sensed gas condition reaches a preselected level. In the illustrated embodiment, the gas sensor is arranged to provide a control signal when the sensor reaches approximately 65% of its initial value.

Further associated with the oven apparatus is a control generally designated 19 and a keypad generally designated 20 connected to the control for selecting different parameters of operation of the oven. The microprocessor control comprises a conventional microprocessor control and the construction and method of operation thereof are well known to those skilled in the control art. The invention comprehends that the control 19 control the power level of the magnetron during its operation and the time during which the magnetron is operated at the controlled power levels.

A schematic diagram illustrating the relationship of the microprocessor 19, the gas sensor 18, and the keypad in controlling the operation of the magnetron is shown in FIG. 1. In the illustrated embodiment, the use of the microwave oven for simmering food F in cavity 12 is effected by the user depressing a Stew/Simmer button 21 of keypad 20, and then a Start button 22 thereof.

Figure 3:
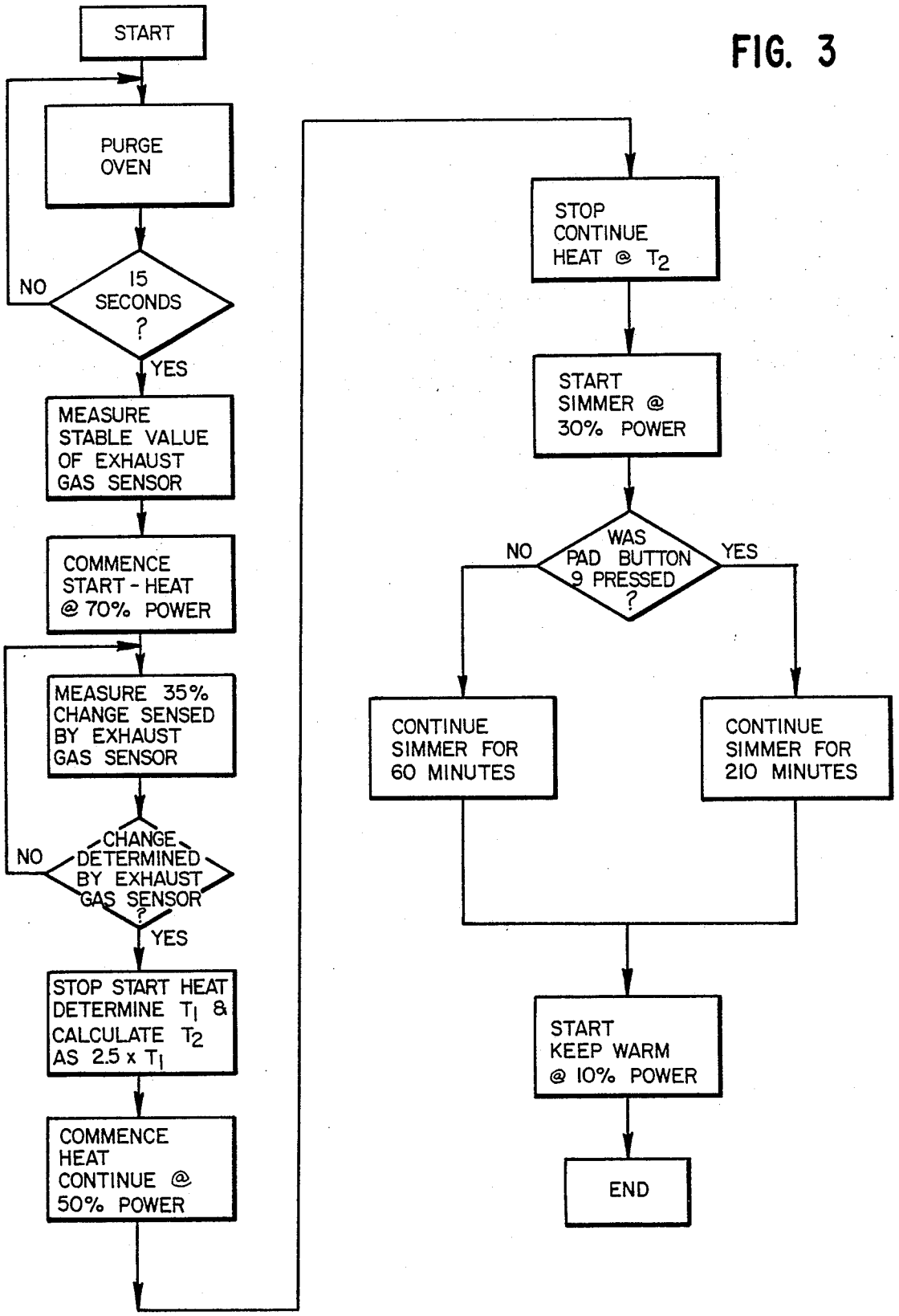
FIG. 3 is a block diagram illustrating the sequential operation of the control is effecting the method of operation of the microwave oven in accordance with the invention.

Referring now to FIG. 3, the control 19 responds to the depression of the buttons 21 and 22 by initiating operation of the blower 16 for 15 seconds to purge the oven cavity. At the end of the purging cycle, the value of the gas sensor 18 is set in the microprocessor.

Control 19 then commences a start-heat operation wherein the generator is operated at 70% of its maximum power. This operation is continued until the gas sensor 18 senses a 65% change in the sensed gas condition of the exhaust air, at which time, the control stops the start-heat operation. The control calculates a continue-heat duration as two and one-half times the time of the sensor-controlled start-heat operation.

Control 19 then commences a continue-heat operation of the magnetron at approximately 50% of its full power for the thusly calculated second period of time.

At the end of the calculated second period of time, the control stops the continue-heat operation and initiates a simmer operation wherein the generator 14 is operated at approximately 30% of its full power. The control continues the simmer operation for 60 minutes. Alternatively, if the user presses the numeral "9" button 23 of the keypad 20 before pressing the Start button 22, the simmer time is caused to be 210 minutes. The control causes the generator to operate at approximately 30% of its maximum power level during the simmer operation.

Upon completion of the selected simmer time period, the control initiates a keep-warm operation at approximately 10% of the maximum power of the microwave generator for a total maximum time of cooking operation of 11 hours and 59 minutes, or until the user removes the food from the microwave oven cavity.

In the illustrated embodiment, the gas sensor comprises a Figaro Gas Sensor TGS#813S. As will be obvious to those skilled in the art, modifications in the above discussed parameters are comprehended within the broad scope of the invention. Illustratively, different parameters may be utilized as desired where the sensor comprises a humidity sensor.

In broad aspect, the simmer operation is carried on for a preselected period of time at less than 50% of the maximum power level of the microwave generator and less than 50% of the power level of the microwave generator during the Start Heating cycle. The Simmer power level is less than 75% of the Continue Heating power level and greater than twice the Keep Warm power level. In the illustrated embodiment, the Simmer power level is approximately 45% of the Start Heating power level, approximately 60% of the Continue Heating power level, and approximately 3 times the Keep Warm power level.

Thus, the invention broadly comprehends the method of simmering food in a microwave oven having a microwave generator defining a preselected maximum power level and having an adjustable control including a timer for causing energization of the generator to deliver microwave energy to food in the oven for selected times and at selected power levels, and means for sensing the degree to which the food in the oven has been cooked by the subjection thereof to the microwave energy. The method includes the steps of causing the control to energize the generator to deliver microwave energy to food in the oven sufficiently to raise the temperature thereof to a heated condition wherein the food is at a Start Simmer temperature slightly below 100° C. The heated condition is sensed and the control causes the energization of the generator as an incident of the sensing means sensing the heated condition to simmer the food for a preselected period of time at a Simmer power level which is less than 50% of the maximum power level. The method comprehends maintaining the power level of the generator at a maintained Warm pure level following the completion of the Simmer operation.

The invention further comprehends the provision of an apparatus for effecting such a microwave simmering operation including means for sequentially causing the control to energize the generator at a high Start Heating power level, then at a lower Continue Heating power level, then at a further lower Simmer power level, and at a further lower Keep Warm power level. The control provides the simmering function automatically as a result of the user pressing a Stew/Simmer button on the control pad.

The foregoing disclosure of specific embodiments is illustrative of the broad inventive concepts comprehended by the invention.

I claim:

1. A method of simmering food in a microwave oven having a microwave generator having a preselected maximum power level, and an adjustable control including a timer for causing energization of the generator to deliver microwave energy to food in said oven for selected times and at selected power levels, and means for sensing the degree to which food is said oven has been cooked by the subjection thereof to said microwave energy, said method comprising the steps of:

causing said control to energize said generator to deliver microwave energy to food in said oven at a first power level to raise the temperature thereof to a preselected heated condition, causing said control to energize said generator to deliver microwave energy to said food at a second power level less than said first power level to raise the temperature thereof to a start-simmer temperature subjacent 100° C.;

causing said control to energize said generator to simmer said food for a period of time at a simmer power level which is less than 50% of said maximum power level; and maintaining the power level of said generator at a maintained-warm power level lower than said simmer power level.

2. The method of simmering food in a microwave oven of claim 1 wherein said simmer power level is approximately 30% of said maximum power level.

3. The method of simmering food in a microwave oven of claim 1 wherein said period of time during which said generator is energized at said simmer power level is selectively variable.

4. The method of simmering food in a microwave oven of claim 1 wherein said period of time during which said generator is energized at said simmer power level is selectively any one of a plurality of different discrete periods of time.

5. The method of simmering food in a microwave oven of claim 1 wherein said period of time during which said generator is selectively energized at said simmer power level is 60 minutes.

6. The method of simmering food in a microwave oven of claim 1 wherein said period of time during which said generator is energized at said simmer power level is selectively 210 minutes.

7. In a microwave oven having a microwave generator having a preselected maximum power level, an adjustable control including a timer for causing energization of the generator to deliver microwave energy to food in said oven for selected times and at selected power levels, and means for sensing the degree to which food in said oven has been cooked by the subjection thereof to said microwave energy, apparatus for providing a controlled continuous simmering of food by said oven, said apparatus comprising:

means for sequentially causing said control to energize said generator at:

(a) a high start-heating power level to bring said food to a preselected heated condition, (b) at a continuous lower continued-heating power level to bring said food to a start-simmer temperature, (c) at a further lower simmer power level, and (d) at a further lower keep-warm power level.

8. The apparatus for simmering food of claim 7 wherein said control comprises means for causing said simmer power level to be less than 50% of the start-heating power level.

9. The apparatus for simmering food of claim 7 wherein said control comprises means for causing said simmer power level to be less than 75% of the continued-heating power level.

10. The apparatus for simmering food of claim 7 wherein said control comprises means for causing said simmer power level to be greater than twice the keep-warm power level.

11. The apparatus for simmering food of claim 7 wherein said control comprises means for causing said simmer power level to be approximately 45% of the start-heating power level.

12. The apparatus for simmering food of claim 7 wherein said control comprises means for causing said simmer power level to be approximately 60% of the continued-heating power level.

13. The apparatus for simmering food of claim 7 wherein said control comprises means for causing said simmer power level to be approximately 3 times the keep-warm power level.

14. The apparatus for simmering food of claim 7 wherein said continued-heating power level is to be maintained for a period of time approximately two and one-half times the duration of said start-heating power level.

15. The apparatus for simmering food of claim 7 wherein said control comprises means for causing said simmer power level to be maintained for a variable period of time.

16. The apparatus for simmering food of claim 7 wherein said control comprises means for causing said simmer power level to be maintained for any one of a plurality of different selectable periods of time.

17. The apparatus for simmering food of claim 7 wherein said control comprises means for causing said simmer power level to be maintained for 60 minutes.

18. The apparatus for simmering food of claim 7 wherein said control comprises means for causing said simmer power level to be maintained for 210 minutes.

19. A method of simmering food in a microwave oven having a microwave generator having a preselected maximum power level, and an adjustable control including a timer for causing energization of the generator to deliver microwave energy to food in said oven for selected times and at selected power levels, and means for sensing the degree to which food in said oven has been cooked by the subjection thereof to said microwave energy, said method comprising the steps of:

causing said control to energize said generator to deliver microwave energy to food in said oven sufficient to raise the temperature thereof to a start-simmer temperature subjacent 100° C., including the steps of sequentially causing the control to energize said generator at a high start-heating power level to bring the food to a preselected heated condition;

sensing said heated condition of the food;

causing said control to energize said generator at a reduced continued-heating power level as an incident of said sensing means sensing said heated condition to bring said food to a simmer temperature; and automatically initiating a simmering of said food for a selectable period of time at a simmer power level which is approximately 30% of said maximum power level to maintain said food selectably at said simmer temperature.

20. The method of simmering food in a microwave oven of claim 19 wherein the amount of time spent in the continued-heating power level is approximately two and one-half times the amount of time spent at the start-heating power level.

21. The method of simmering food in a microwave oven of claim 19 wherein the selectable period of time is selectively (a) 60 minutes, or (b) 210 minutes.

22. The method of simmering food in a microwave oven of claim 19 including further steps of maintaining the power level of said generator at a maintained-warm power level lower than said simmer power level, said maintained-warm power level being approximately 10% of said maximum power level.

23. The method of simmering food in a microwave oven of claim 19 wherein said sensing means comprises an exhaust gas sensor.

24. The method of simmering food in a microwave oven of claim 23 wherein said heated condition of the food corresponds to 65% of the stable value of said exhaust gas sensor.

* * * * *